United States Patent [19]

van den Broek

[11] 4,080,670

[45] Mar. 28, 1978

[54] GUTTER SYSTEM

[75] Inventor: William A. van den Broek, Doylestown, Pa.

[73] Assignee: KDI Sylvan Pools, Inc., Doylestown, Pa.

[21] Appl. No.: 731,734

[22] Filed: Oct. 12, 1976

[51] Int. Cl.[2] ..... E04H 3/20

[52] U.S. Cl. ..... 4/172.17; 52/169.5

[58] Field of Search ..... 4/172, 172.15–172.19, 4/172.21, 150, 181; 52/11, 102, 169.5, 169.7

[56] References Cited

U.S. PATENT DOCUMENTS

| | | | |
|---|---|---|---|
| 3,059,243 | 10/1962 | Ross et al. | 4/172.19 |
| 3,432,867 | 3/1969 | Whitten | 4/172.17 |
| 3,564,791 | 2/1971 | Arp | 4/172.19 X |
| 3,908,207 | 9/1975 | van den Broek | 4/172.17 |
| 3,939,504 | 2/1976 | Linecker | 4/172.17 |
| 3,990,167 | 11/1976 | Whitten | 4/172.17 X |

*Primary Examiner*—Richard E. Aegerter
*Assistant Examiner*—Stuart S. Levy
*Attorney, Agent, or Firm*—Zachary T. Wobensmith, 2nd; Zachary T. Wobensmith, III

[57] ABSTRACT

A gutter system is described for use around the perimeter of a swimming pool for skimming the surface water of the pool, and for returning clean water to the pool, which includes an open box like gutter body, made in two vertical halves with a cover plate detachably connecting the vertical halves at the top and a vertical lip extending from each gutter half at the bottom abutting and connected together by bolts. The gutter halves are formed in sections of uniform length which each have an overlapping portion at one end for telescoping engagement with the adjacent gutter length, and with brackets adjacent the ends of the gutter sections with bolts therethrough to hold the sections together.

The gutter halves are bolted at the bottom to adjustable anchoring and support brackets fastened to the pool wall. The meeting points of the front and rear gutter sections may be staggered so that the front and back seams are not at the same location. The gutter sections at the corners of the pool are detachably engaged by bolts with four sided open boxes which boxes may have pairs of opposite walls perpendicular to or angularly related to each other to accommodate the desired shape of the finished pool wall. A return water or header pipe is located inside the gutter body with fittings attached thereto, and with one portion of each fitting detachably fastened to nipples, which may be welded to the front wall of the front gutter half and to the bottom wall at an upward inclination to the bottom wall, providing for passage of clean water into the pool through the front wall of the gutter.

13 Claims, 12 Drawing Figures

FIG. 1
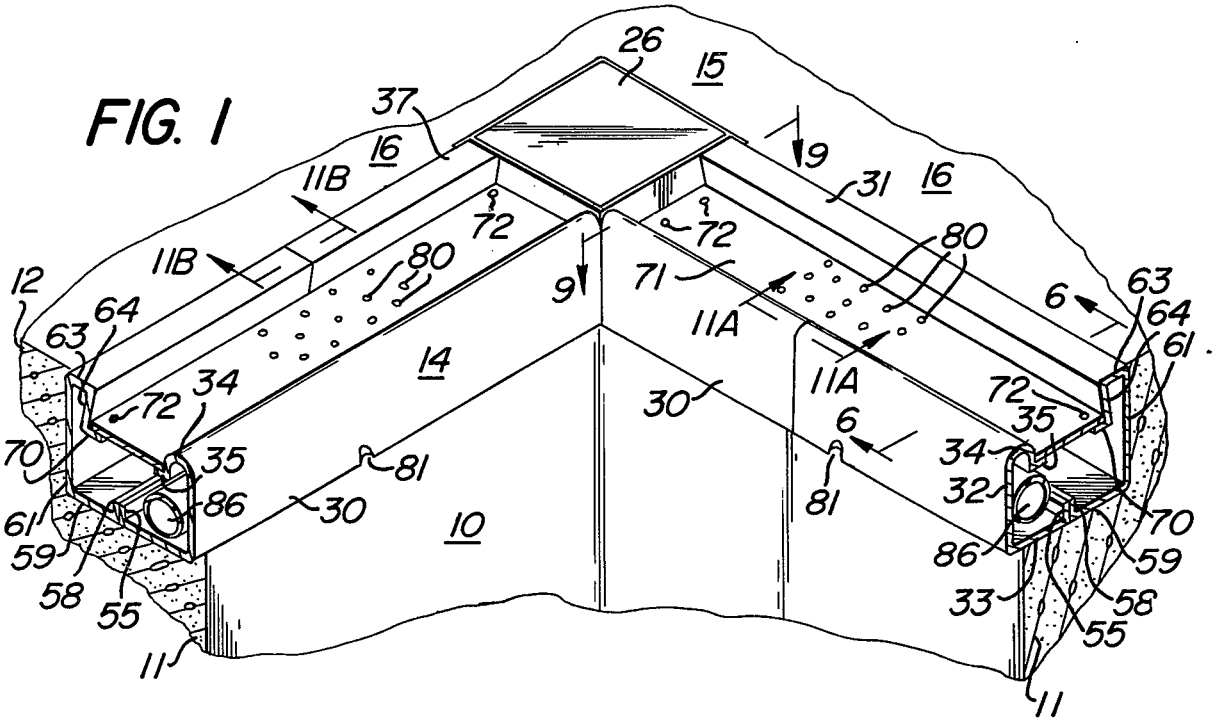
FIG. 2
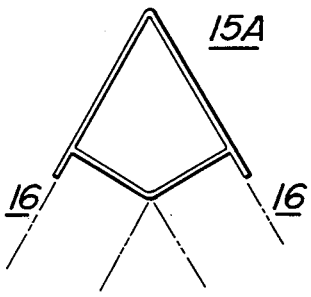
FIG. 3
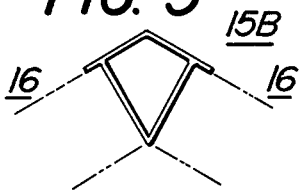
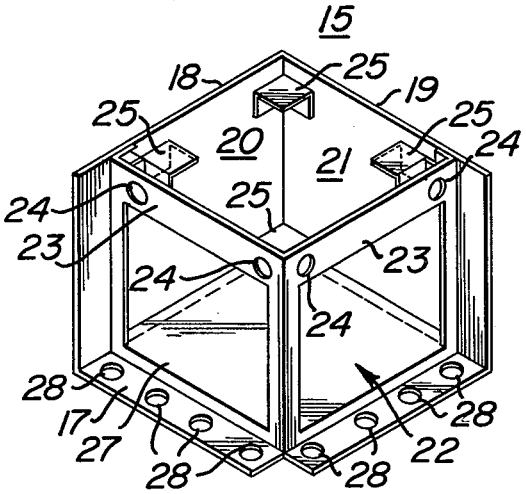
FIG. 5
FIG. 4
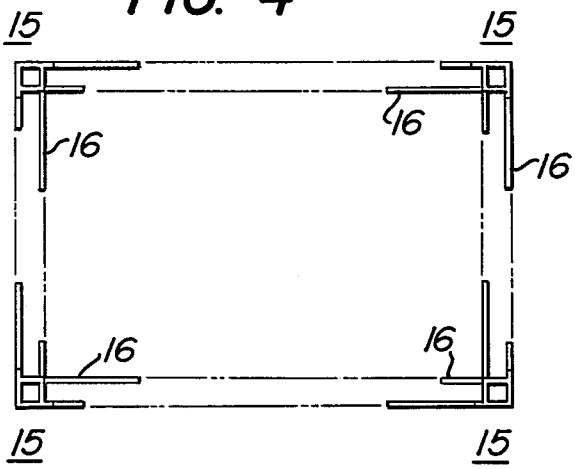

FIG. 6
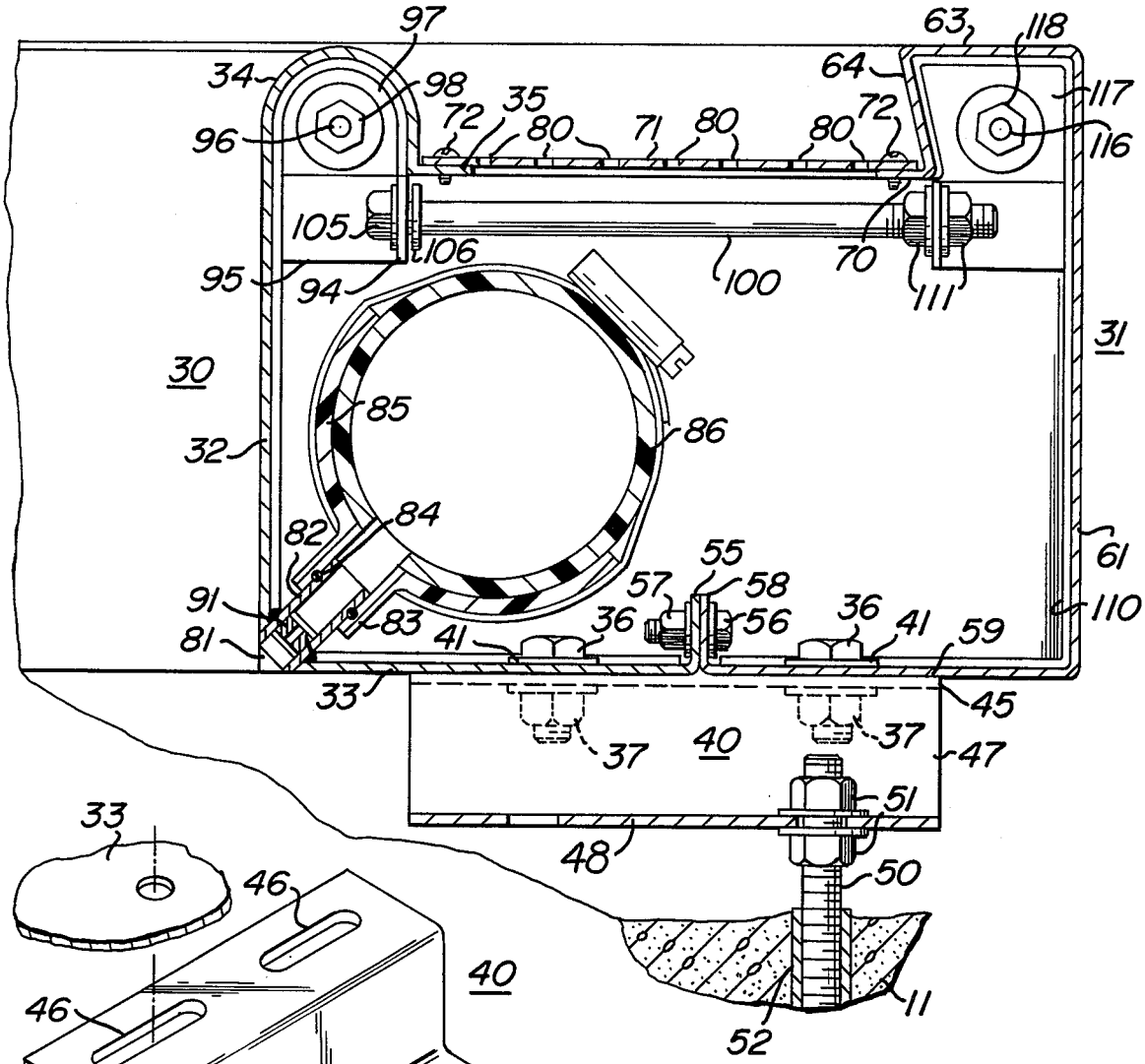
FIG. 8
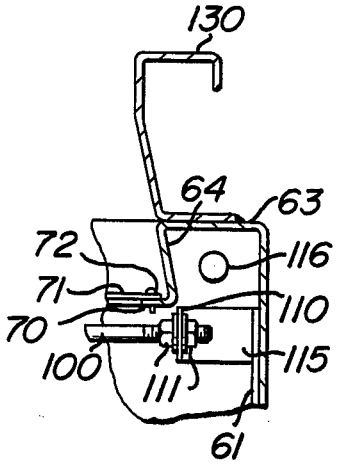
FIG. 7

FIG. 9
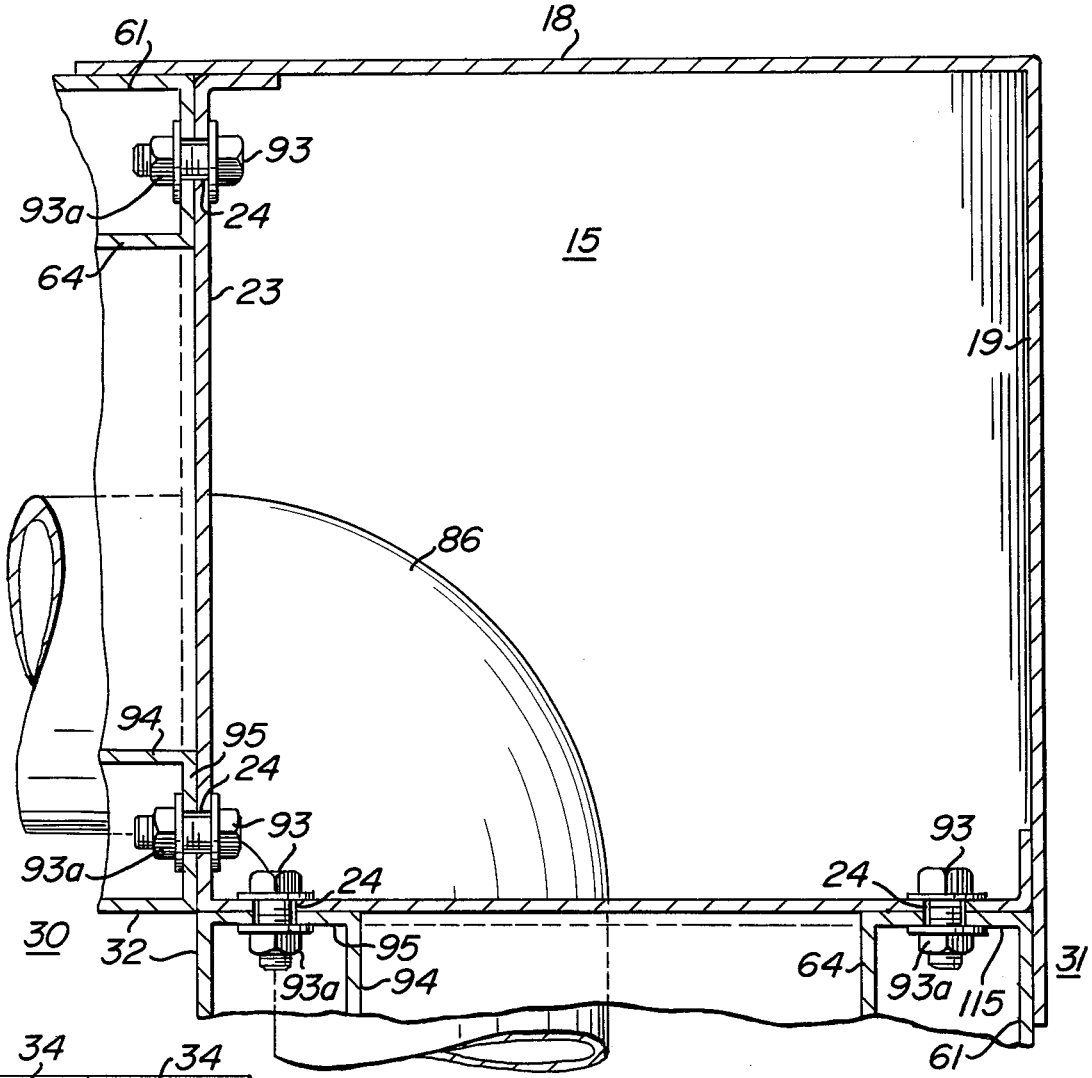
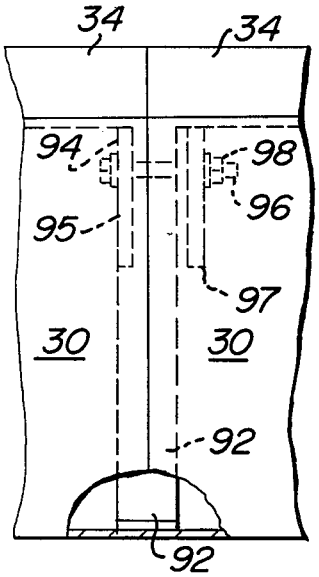
FIG. 10
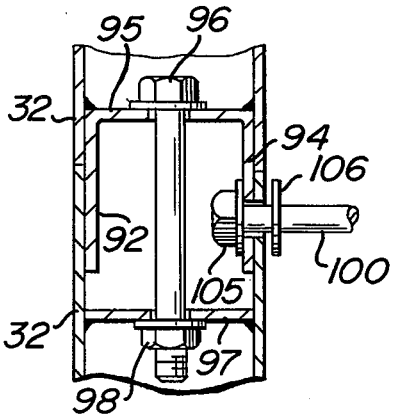
FIG. 11A
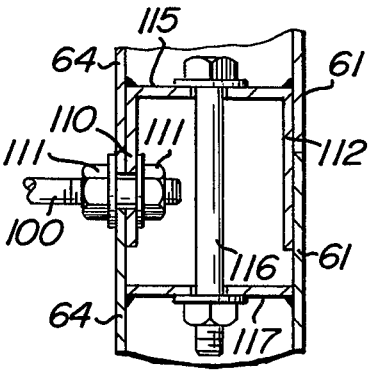
FIG. 11B

GUTTER SYSTEM

The foregoing abstract is not to be taken as limiting the scope of my invention and in order to understand the full nature and extent of the technical disclosure of this patent, reference must be made to the accompanying drawings and the following detailed description.

BACKGROUND OF THE INVENTION

1. Field of the Invention

This invention relates to a recirculating gutter of the prefabricated type which is assembled in the field without welding and is readily adaptable to various sizes and configurations of pools.

2. Description of the Prior Art

Overflow gutters for recirculating water from swimming pools have been in use for many years. Such gutters with a return water conduit in or adjacent to the gutter body are desirable because they provide for skimming the dirty surface water of the pool and returning clean water to the pool all without the use of pipes buried in the pool walls. Examples of such gutter systems are shown in the U.S. Pat. to Ogden No. 2,932,397 and Whitten No. 3,432,867.

While the Whitten and Ogden types of gutters generally operate satisfactorily, they are difficult to install, and are not readily adaptable to pools other than those having walls perpendicular to each other. The systems disclosed by Whitten and Ogden utilize stainless steel gutter sections which must be welded together in the field at spaced locations around the perimeter of the pool. The assembly of the stainless steel gutter sections require that they be lined up; tack welded together; and that they then be finished welded. The welds must then be ground and polished. The welding of the sections together inherently causes the sections to distort so that it is virtually impossible to obtain a smooth, finished straight front gutter wall. The welds at meeting sections are often incomplete, permitting water infiltration therebetween into the gutter interior.

Skilled labor is required to install the Whitten and Ogden types of gutters, which gutters cannot be easily removed for repair or replacement, if such should be required, so that they are practically custom made for each pool installation.

The gutter system of my invention does not require any welding in the field, can be prefabricated in sections at the factory and shipped to the job where it is easily installed by relatively unskilled labor, can be removed at any time as desired, and can be used with pools of varying sizes and configurations without more than minor modification.

The gutter system of my invention permits the utilization of a lighter gauge stainless steel than is required by the Whitten and Ogden systems, is easily and quickly leveled and when assembled, provides a smoother and straighter front gutter wall. The gutter system is designed so that its installation is simple and the element of human error in assembly is considerably reduced from that of prior systems.

SUMMARY OF THE INVENTION

This invention relates to a recirculating gutter system for skimming the dirty water from a pool surface and returning clean water throught nozzles in the front wall of the gutter, which gutter system is of box like configuration open at the top and closed with perforated plates detachably fastened thereto.

The gutter system is constructed of multiple sections of front and rear halves bolted together at the top and the bottom with an internal overlapping plate portion inside the walls at one end of each gutter section and bolts therethrough securing adjacent sections together.

The gutter sections at the corners are detachably engaged to four sided corner boxes, open at the top, to which the sections are fastened and which extend thereinto. The corner boxes are closed at the top by plates which can be removed for access. A return water pipe is located in the gutter with removable fittings attached thereto and detachably connected to nipples welded to the front and bottom walls for returning clean water to the interior of the pool.

The principal object of the invention is to provide a gutter system than can be prefabricated in a factory and assembled on the job without in-field welding.

A further object of the invention is to provide a gutter system that provides a finished appearance superior to that of other available systems.

A further object of the invention is to provide a gutter system that can be easily disassembled in its entirety or in parts for repair or replacement if required.

A further object of the invention is to provide a gutter system that can be used on various sizes and configurations of pools with relatively minor modifications.

A further object of the invention is to provide a gutter system that can be quickly and easily installed on a pool by unskilled labor.

A further object of the invention is to provide a gutter system that has good water infiltration resistance.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which:

FIG. 1 is a perspective view of a protion of the gutter system of my invention illustrating a typical corner of the gutter and adjoining gutter sections;

FIG. 2 is a schematic view illustrating one embodiment of corner box used with the gutter system shown in FIG. 1;

FIG. 3 is a schematic view, similar to FIG. 2, illustrating another embodiment of corner box used with the gutter system shown in FIG. 1;

FIG. 4 is a schematic view of one embodiment of the gutter system;

FIG. 5 is a perspective view illustrating in detail one embodiment of corner box used with the gutter system;

FIG. 6 is a vertical sectional view, enlarged, taken approximately on the line 6—6 of FIG. 1;

FIG. 7 is a fragmentary vertical sectional view illustrating a portion of a high end wall employed on some pools in conjunction with the gutter system;

FIG. 8 is an exploded perspective view showing an anchoring bracket used with the gutter system;

FIG. 9 is a horizontal sectional view, enlarged, taken approximately on the line 9—9 of FIG. 1;

FIG. 10 is a fragmentary front view illustrating the joining of two adjacent gutter sections;

FIG. 11A is a horizontal sectional view, enlarged, taken approximately on the line 11A—11A of FIG. 1; and FIG. 11B is a fragmentary horizontal sectional view taken approximately on the line 11B—11B of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings and FIGS. 1, 4, 5, and 6, and 8 to 11B, inclusive, a preferred embodiment of the gutter system of my invention is illustrated installed on a concrete pool 10 of well known type. The pool 10 includes vertical walls 11 and perimeter deck 12. A gutter system 14 is provided which extends around the perimeter of the pool 10 in a perimeteral groove at the intersection of the wall 11 and deck 12. The gutter system 14 preferably includes corner gutter box portions 15 of box like configuration and gutter side sections 16.

The corner gutter boxes 15 are prefabricated at the factory. One embodiment, illustrated in FIG. 5, is shown as open at the top with a bottom wall 17, rear walls 18 and 19, and front walls 20 and 21, disposed in perpendicular relation. The walls 18 and 19 are solid, and the walls 20 and 21 have openings 22 therethrough. The walls 20 and 21 have solid portions 23 adjacent the top with holes 24 to accommodate bolts (not shown) for fastening of the gutter side sections 16 thereto. The boxes 15 each has a plurality of brackets 25 inside walls 18, 19, 20, and 21 spaced therearound which can support a plate 26 to close off the top of each box 15, and a plate 27 fastened to the bottom wall 17 to which the walls 20 and 21 are fastened such as by welding. The bottom wall 17 has openings 28 therethrough spaced around the open sides of the box to accommodate bolts (not shown) from the gutter side section 16.

Other embodiments of gutter boxes 15A and 15B are illustrated in FIGS. 2 and 3 which are for use with pools having non-perpendicular walls.

The pool gutter side sections 16 are of box like configuration open at the top and formed from a front half 30 and a rear half 31. The front half 30 has a vertical front wall 32 facing the interior of the pool with a horizontal bottom wall 33 and a semi-circular handgrip 34. The handgrip 34 has a small lip 35 attached thereto facing the exterior of the pool 10.

The front gutter half 30 is attached to the pool wall 11 by bolts 36 and nuts 37 which extend through the bottom wall 33 and are engaged with support and anchoring brackets 40. A fibre washer 41 is provided between the bolts 36 and wall 33 for sealing.

The bracket 40 of modified Z-shape have an upper arm 45 with elongated slots 46 which engage the bolts 36, and a central arm 47 connecting the upper arm 45 to a lower arm 48 which has elongated slots 49 engaged by anchor bolts 50 secured in lugs 52 in walls 11 of the pool 10, and by nuts 51 engaged with the bolts 50 on either side of arm 48.

The elongated slots 46 and 49 provide for horizontal lengthwise and transverse adjustment of the gutter sections 16 to correct for dimensional variations in pool construction and in gutter sections.

The bottom wall 33 of front half 30 has a vertical upwardly extending lip 55 extending lengthwise thereof with bolts 56 and nuts 57 connecting it to an identical vertical upwardly extending lip 58 on bottom wall 59 of rear gutter half 31. The gutter half 31 has a rear wall 61 connected to bottom wall 59 and a top wall 63 connected to rear wall 61. An inner wall 64 is connected to top wall 63 and has a lip 70 extending therefrom which has perforated cover plates 71 resting thereon and attached thereto by self tapping screws 72 which plates 71 are also engaged with lip 35 of front half 30 and held by self tapping screws 72.

The rear gutter half 31 which also rests on brackets 40 has bolts 36 and nuts 37 which are engaged with its bottom wall 59, with the slots 46 and has fibre washers 41 between the wall 59 and the bolts 36 for sealing.

The gutter halves 30 and 31 as well as the brackets 40 are preferably made of stainless steel to reduce the incidence of corrosion and to provide an attractive appearance.

The cover plates 71 can be fabricated of any desired material, polyethelene plastic and stainless steel being preferred for most installations, with holes 80 therethrough to permit of water drainage into the gutter.

The front wall 32 of gutter half 30 has openings 81 therethrough and through bottom wall 33 at the intersection thereof at spaced intervals along the half 30 with the preferred spacing being on four foot centers with a section length of eight feet. Nipples 82 are welded into the openings 81 to both the front and bottom walls 32 and 33 and inclined upwardly from the bottom wall 33 at an angle of approximately 60°. The outlet extensions 83 of fittings 85 are engaged with the nipples 82 and retained thereon by sealing O-rings 84. The fittings 85 can be of any preferred type with saddle fittings having been found to be satisfactory.

The fittings 85 are engaged with a water return or header pipe 86 which extends around the perimeter of the pool and is connected to a source of filtered clean water to be returned to the pool. The header pipe 86 and fittings 85 are preferably made from polyvinylchloride (PVC) of conventional type with the pipe 86 in a preferred embodiment being of the order of three or four inch diameter and the outlet extensions 83 being of one inch diameter.

If desired and to satisfy low water pressure or health code requirements, orifice plugs 91 with orifices of predetermined size can be provided threaded or otherwise engaged in nipples 82, to maintain proper outlet water pressure around the pool perimeter.

Each gutter section 16 has at one end of each front half 30 a plate 92 secured thereto on the inside of wall 32 of the section extending from the lip 55 of bottom wall 33 upwardly around the front wall 32, handgrip 34 and with a modified U-shaped configuration adjacent the handgrip 34, with an extension 94 and plate 95 connecting the plate 92 and extension 94. (See FIGS. 6, 10, and 11A)

The plate 92 has a width in the preferred embodiment of approximately one inch and overlaps an adjacent front half 30 of gutter section 16 by approximately one half inch. (See FIG. 10)

Bolts 96 extend through plate 95 and are engaged with a plate 97 carried on the end of an adjacent front half 30 of section 16 with nuts 98 securing together the gutter front halves 30. (See FIG. 11A)

The extension 94 of front half 30 has a spacer bolt 100 engaged therewith (See FIGS. 6, 11A and 11B) with its head 105 and washer 106, which is welded to bolt 100, retaining the bolt from other than rotational movement in extension 94. The bolt 100 extends outwardly from extension 94 and is detachably engaged in a similar extension 110, by nuts 111. The plate 110 is connected to a plate 112 by a plate 115 which plate 115 is secured to rear gutter half 31. The plate 115 has bolts 116 engaged therewith and with a plate 117 carried in an adjacent gutter half 31 with nuts 118 securing the adjacent gutter sections 31 together.

The front gutter half 30 adjacent to the pool corners has bolts 93 and nuts 93A engaged with the plates 95 and with holes 24 and 28 of box 15. The rear gutter half 31 adjacent the pool corners has bolts 93 and nuts 93A engaged in a plate 115 and in the rearmost holes 24 and 28 in the box 15.

The front and rear gutter halves 30 and 31 could also be used with the boxes 15A and 15B of FIGS. 2 and 3 and with other box configurations as desired without modification to the gutter halves 30 and 31.

If desired, and as illustrated in FIG. 7, a high end wall extension 130 can be employed, attached to the top wall 63 of rear gutter half 31.

In practice it is preferable from a manufacturing standpoint to manufacture gutter sections 30 and 31 of a length not to exceed eight feet so that they can be easily shipped and installed on the job, such size being suitable for a wide range of pool sizes and being easily transportable.

In order to install the gutter system 14, corner gutter boxes 15, 15A or 15B as shown in FIGS. 2, 3, and 5 and of the proper shape for the corners of a specific pool, are positioned at the corners. A cord or line is then stretched between the corners and the front gutter halves 30 are positioned along the pool walls between the corners, leveled by adjustment of the nuts 51 on bolts 50, moved lengthwise or transversely on brackets 40, and secured to brackets 40 by bolts 36.

The adjacent front gutter halves 30 are coated with gasket cement or other suitable adhesive material at the meeting surfaces and are bolted together end to end by bolts 95 and nuts 98 with the plates 95 and 97 providing for precise alignment of front walls 32 and for sealing between the adjacent gutter sections, which may also be caulked with water-proof material if desired.

The rear gutter halves 31 can then be bolted together by bolts 116 and nuts 118 through plates 110 and 112 and to the front gutter sections 30 by bolts 56 and nuts 57 at the bottom, with gasket cement or other suitable waterproof adhesive material applied to lips 55 and 58.

The bolts 100 are engaged in the rear gutter extension 110 and the front to back distance adjusted as desired by positioning nuts 111.

The header pipe 86 and fittings 85 are assembled and the extensions 83 are engaged with the nipples 82.

The cover plates 71 are installed by self tapping screws 72 extending therethrough and on through the lips 35 and 70. The plates 71 are readily removable for access to the interior of the gutter system 14 for cleaning and repair or replacement of pipes 86 and fittings 85, as desired.

The gutter sections 30 and 31 are spaced from the rough portion of the pool which leaves a gap between the bottom of the gutter and the pool wall and the back of the gutter section 31 and the rough pool wall. Such gaps are filled, after the gutter system 14 has been installed, with portland cement or other suitable grouting material.

It will thus be seen that structure has been provided with which the objects of the invention are achieved.

I claim:

1. A non-welded gutter system for use around the perimeter of a swimming pool for skimming the surface water of the pool and returning clean water to the pool which comprises an open box like gutter body having a plurality of lengths of gutter side sections detachably secured together in end to end relation, said side sections each having a front portion with a front wall, a bottom wall and a handgrip on said front wall, said side sections each also having a rear portion with a rear wall, a top wall and a bottom wall, means for fastening said front and rear portions together, said means comprising vertical lips on said bottom walls and bolts engaged therewith, corner boxes at each corner to which one end of a pair of said front and one end of a pair of said rear portions are detachably fastened, cover plates detachably connected to said front and said rear portions, means for supporting the gutter body with respect to a pool for vertical and for transverse horizontal adjustment, and water supply means carried within said body comprising header pipes and fittings which communicate with the pool through the front wall.

2. A non-welded gutter system as defined in claim 1 in which said fittings are saddle fittings connecting said header pipes and with portions for delivery of water through the gutter body.

3. A non-welded gutter system as defined in claim 2 in which said front wall has outlets therethrough to which said fittings are detachably connected.

4. A non-welded gutter system as defined in claim 3 in which said outlets are nipples connected at said openings to which said fittings are detachably connected.

5. A non-welded gutter system as defined in claim 1 in which said vertical lips extend upwardly within said gutter body.

6. A non-welded gutter system as defined in claim 1 in which said means for fastening said front and rear portions together includes adjustable spacer bolts connecting upper portions of said sections.

7. A non-welded gutter system as defined in claim 1 in which said corner boxes are of a shape to conform with the shape of the corner of the pool.

8. A non-welded gutter system as defined in claim 1 in which said corner boxes are of square shape.

9. A non-welded gutter system as defined in claim 1 in which said corner boxes have upright walls at an acute angle with respect to each other.

10. A non-welded gutter system as defined in claim 1 in which said support means comprise brackets secured to said front and said rear portions, and upright bolts are provided to which said brackets are secured.

11. A non-welded gutter system as defined in claim 10 in which said brackets have elongated openings for adjustment horizontally in a plurality of directions.

12. A non-welded gutter system as defined in claim 1 in which said support means have at least one of said front and rear portions connected thereto.

13. A non-welded gutter system as defined in claim 1 in which said gutter side section being secured together in end to end relationship by plates with which contiguous side sections are in overlapped relation, and with bolts extending between said side sections.

* * * * *

UNITED STATES PATENT OFFICE

CERTIFICATE OF CORRECTION

Patent No. 4,080,670 Dated March 28, 1978

Inventor(s) William A. van den Broek

It is certified that error appears in the above-identified patent and that said Letters Patent are hereby corrected as shown below:

Column 5,

Line 38, "bolts 95" should read "bolts 96"

Signed and Sealed this

*Fourth* Day of *July 1978*

[SEAL]

*Attest:*

RUTH C. MASON
*Attesting Officer*

DONALD W. BANNER
*Commissioner of Patents and Trademarks*